US007091914B2

(12) United States Patent
Noguchi et al.

(10) Patent No.: US 7,091,914 B2
(45) Date of Patent: Aug. 15, 2006

(54) GLASS ANTENNA FOR VEHICLE

(75) Inventors: Akihiro Noguchi, Matsusaka (JP); Hiroyuki Fujii, Matsusaka (JP); Kanya Hirabayashi, Matsusaka (JP)

(73) Assignee: Central Glass Co., Ltd., Yamaguchi (JP)

( * ) Notice: Subject to any disclaimer, the term of this patent is extended or adjusted under 35 U.S.C. 154(b) by 6 days.

(21) Appl. No.: 10/879,631

(22) Filed: Jun. 30, 2004

(65) Prior Publication Data

US 2005/0030235 A1 Feb. 10, 2005

(30) Foreign Application Priority Data

Jun. 30, 2003 (JP) ..... 2003-188830

(51) Int. Cl.
*H01Q 1/32* (2006.01)

(52) U.S. Cl. ..... 343/713; 343/704

(58) Field of Classification Search ..... 343/713, 343/704

See application file for complete search history.

(56) References Cited

U.S. PATENT DOCUMENTS 5,231,410 A * 7/1993 Murakami et al. ..... 343/713

FOREIGN PATENT DOCUMENTS

| | | |
|---|---|---|
| JP | 8-84011 | 3/1996 |
| JP | 9-69713 | 3/1997 |

* cited by examiner

*Primary Examiner*—Michael C. Wimer
(74) *Attorney, Agent, or Firm*—Pillsbury Winthrop Shaw Pittman LLP

(57) ABSTRACT

A glass antenna for a vehicle includes: a window to be disposed along a metal window frame. The window includes a first wire, a second wire and a heating conductor wire. The first wire is capacitive-coupled with a part of the metal window frame. The second wire is capacitive-coupled with the heating conductor wire. The first wire and the second wire are connected with each other.

9 Claims, 3 Drawing Sheets

GLASS ANTENNA FOR VEHICLE

BACKGROUND OF THE INVENTION

1. Field of the Invention

The present invention relates to an antenna for AM/FM radio broadcast bands and television broadcast bands disposed on the upper remaining part above heating conductor wires of a defogger mounted on the rear window of automobiles.

2. Background Art

Hitherto, in the case where a glass antenna is mounted on a window of vehicles, the antenna mounted on the rear window is generally adopted because it blocks a driver's view when it is mounted on the front window on the driver side.

Many applications have been filed in the past regarding the glass antenna for the AM radio broadcast waves/FM radio broadcast waves and the TV broadcast waves. The upper remaining part above the heating conductor wires on the rear window has relatively large space for mounting a glass antenna, and the receive gain can be increased as the position to mount the antenna is higher. Therefore, the glass antenna is mounted on the upper remaining part in the most cases, and there are many antennas commercially available.

On the other hand, a defogger, in which current is carried between bus bars connected to both ends of a plurality of heating conductor wires disposed nearly horizontally by a direct-current power supply and the conductor wires disposed nearly horizontally are heated to defog a window, is also used as an antenna in many cases in addition to functioning it as a defogger.

The defogger like this is often used as an antenna. The defogger is disposed with conductor wires arranged nearly vertically and orthogonal to the heating conductor wires formed of a plurality of nearly horizontal wires and they are connected to an antenna terminal directly through leads from the heating conductor wires or bus bars of the defogger. Alternatively, a part of the horizontal wires of an antenna element mounted on the upper remaining part above the defogger is brought close to the heating conductor wire of the defogger and capacitive-coupled thereto.

For example, JP-A-9-69713 discloses a glass antenna for automobile windows including: a feeding terminal formed on the surface of a window; an antenna device conductor; a connection line for outputting reception signals of the antenna device conductor to the feeding terminal on the corner part of the window or the side part of the window; and two conductor lines, wherein one of the two conductor lines is disposed along the edge of the window, one end of this conductor line is connected to the connection line joined to the antenna device conductor, and the other end is an open end, and the other of the two conductor line is disposed along the conductor line, one end of this conductor line is connected to the feeding terminal, and the other end is an open end.

Furthermore, JP-A-8-84011 discloses a glass antenna having defoggers and antenna conductors extended on the glass, the glass antenna including: a feeding point disposed above or below the defoggers; first antenna conductor elements in a closed loop form fed from the feeding point and extended along the glass surface; and a second antenna conductor vertically extended along the glass surface in the area where the defogger is extended and a part thereof directly connected to a part of a hot wire of the defogger, wherein the first antenna conductor elements are disposed with respect to the defoggers so that the hot wire connected a part of the second antenna conductor element is capacitive-coupled to a part of the first antenna conductor element.

SUMMARY OF THE INVENTION

Although the glass antenna described in JP-A-9-69713 is designed to obtain the performance of high-gain antenna reception with respect to the vertical polarization having frequencies of 88 to 108 MHz in the FM radio broadcast band, it is difficult to obtain the performance of high-gain antenna reception with respect to the horizontal polarization and vertical polarization of wide-band frequencies in the FM radio broadcast waves having a frequency band of 88 to 108 MHz and the FM radio broadcast waves having a frequency band of 76 to 90 MHz as well as it is difficult to receive the AM radio broadcast waves.

Moreover, in the glass antenna described in JP-A-8-84011, the antennas disposed on the upper remaining part above the defogger are capacitive-coupled to a part of the heating wire of the defogger as well as the antennas are directly connected to the heating wire. Therefore, a capacitor is needed for blocking the direct-current power supply of the defogger, and in addition to this, noises inevitably enter from a vehicle when the defogger is used as an antenna for the AM broadcast waves because the hot wire is directly connected to the antenna.

The invention has been made in view of these problems, and is to provide a glass antenna having only a single antenna disposed on the upper remaining part of a rear window, which can obtain the performance of high-gain antenna reception with respect to wide-band frequencies in the FM radio broadcast waves having a frequency band of 76 to 90 MHz and the FM radio broadcast waves having a frequency band of 88 to 108 MHz, and can also excellently receive the AM broadcast waves and TV broadcast waves.

The invention provides a glass antenna for a vehicle, including: a rear window surrounded by a metal window frame. The rear window includes a defogger and antenna wires disposed on an upper remaining part of the rear window above the defogger. The defogger has a plurality of horizontal heating conductor wires extending almost horizontally and bus bars connected to both ends of the plurality of horizontal heating conductor wires. The antenna wires include: a feeding point disposed at a position near an inner-upper side or vertical side of the metal window frame; a first horizontal wire extending from the feeding point and being disposed along the inner-upper side of the metal window frame at an interval within a range of 1 to 10 mm to be capacitive-coupled thereto; and two elements each branched from and connected to the first horizontal wire. The two elements are disposed in respective areas that constitute a right half part and a left half part of the upper remaining part. Each of the two elements has a second horizontal wire disposed along one of the horizontal heating conductor wires at an interval within a range of 1 to 10 mm to be capacitive-coupled thereto.

The invention may provide a glass antenna for a vehicle, including: a rear window surrounded by a metal window frame, the rear window including antenna wires and a defogger having a plurality of heating conductor wires. The antenna wires include: a feeding point; a first wire extending from the feeding point and being disposed along a part of the metal window frame to be capacitive-coupled thereto; and a pair of second wires that are connected to the first horizontal wire and capacitive-coupled with one of the heating conductor wires at mutually different positions.

The invention may provide a glass antenna for a vehicle, including: a window to be disposed along a metal window frame. The window includes a first wire, a second wire and a heating conductor wire. The first wire is capacitive-coupled with a part of the metal window frame. The second wire is capacitive-coupled with the heating conductor wire; and the first wire and the second wire are connected with each other.

BRIEF DESCRIPTION OF THE DRAWINGS

The present invention may be more readily described with reference to the accompanying drawings.

DETAILED DESCRIPTION OF THE PREFERRED EMBODIMENTS

As shown in FIGS. 1 to 4, the invention is an antenna for receiving the AM/FM radio bands and TV bands disposed on the upper remaining part above a defogger 2 mounted on a rear window 1 of a vehicle such as an automobile, which can obtain high receiving sensitivity and directional patterns particularly in the FM bands with respect to the horizontal polarization and vertical polarization of wide-band frequencies in the FM radio broadcast waves having a frequency band of 76 to 90 MHz and the FM radio broadcast waves having a frequency band of 88 to 108 MHz.

Figure 4:
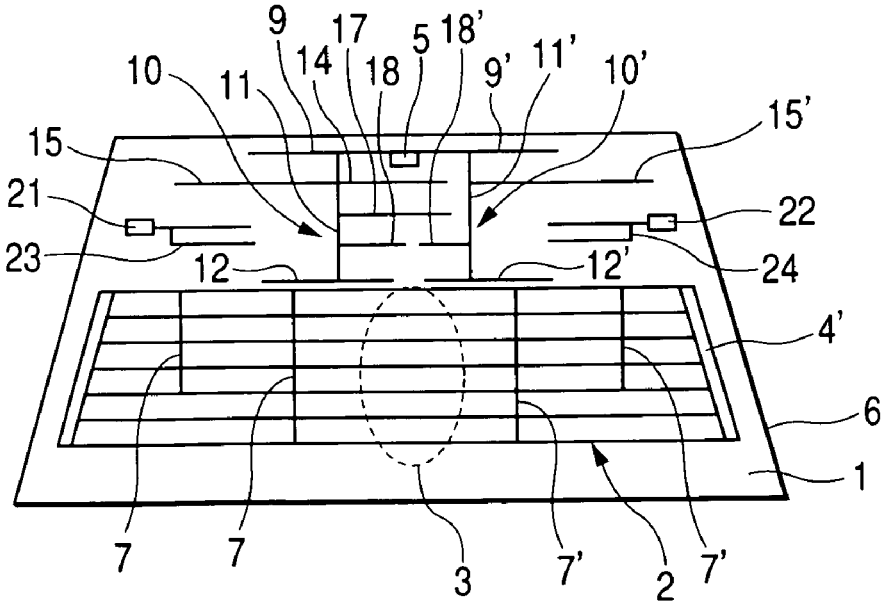
FIG. 4 is a front view illustrating embodiment 4 according to the invention in which a glass antenna is mounted on a rear window for automobiles.

As shown in FIG. 4, in the antenna according to the invention, a feeding point 5 is disposed at the position near the upper side or vertical side of the inner opening part of a metal window frame 6 of the rear window, first horizontal wires 9, 9' are extended from the feeding point 5 along the window frame 6 in one direction or both directions, two elements formed of a first element 10 and a second element 10' branched from the first horizontal wires 9, 9' are arranged downward toward the defogger 2.

The first horizontal wires 9, 9' are brought close to the inner opening part of the upper side of the window frame 6 and capacitive-coupled thereto within the range of 1 to 10 mm. The two elements formed of the first element 10 and the second element 10' branched from the first horizontal wires 9, 9' are arranged at a given position one each in the areas where the upper remaining part is divided into two nearly equal parts right and left.

The two elements of the first element 10 and the second element 10' individually have vertical wires 11, 11' branched from the first horizontal wires 9, 9', and second horizontal wires 12, 12' are disposed from the lower ends of the vertical wires 11, 11'. The second horizontal wires 12, 12' are brought close to the uppermost wire of heating conductor wires 3 and capacitive-coupled thereto within the range of 1 to 10 mm. The components of the two elements of the first element 10 and the second element 10' formed of the vertical wires 11, 11' and the second horizontal wires 12, 12' are in an inverted T-shape.

The components of the two elements of the first element 10 and the second element 10' formed of the vertical wires 11, 11' and the second horizontal wires 12, 12' are in an inverted T-shape as shown in FIG. 4, but any combinations of an L-shape and an inverted T-shape are acceptable.

Figure 1:
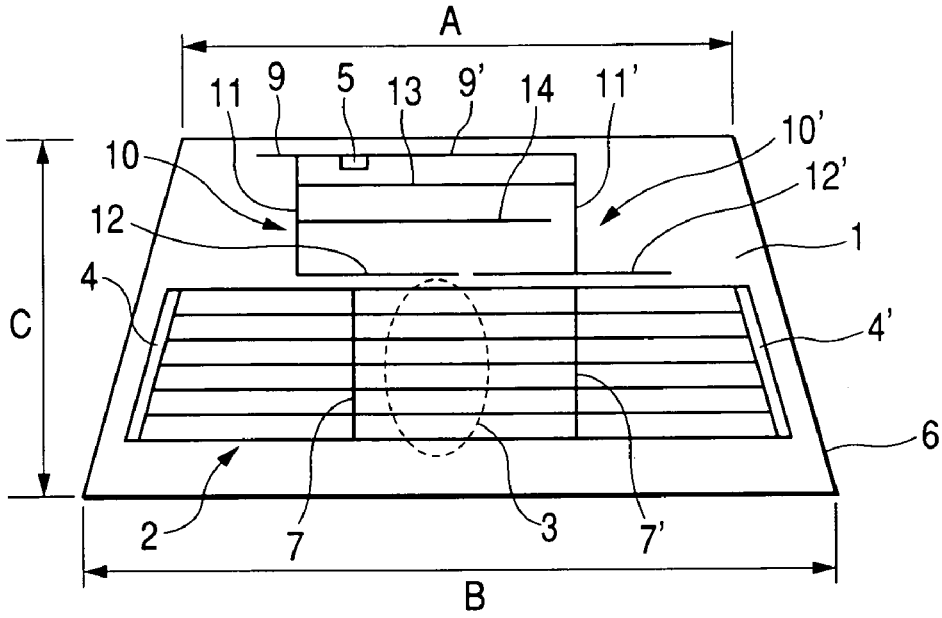
FIG. 1 is a front view illustrating embodiment 1 according to the invention in which a glass antenna is mounted on a rear window for automobiles.
Figure 2:
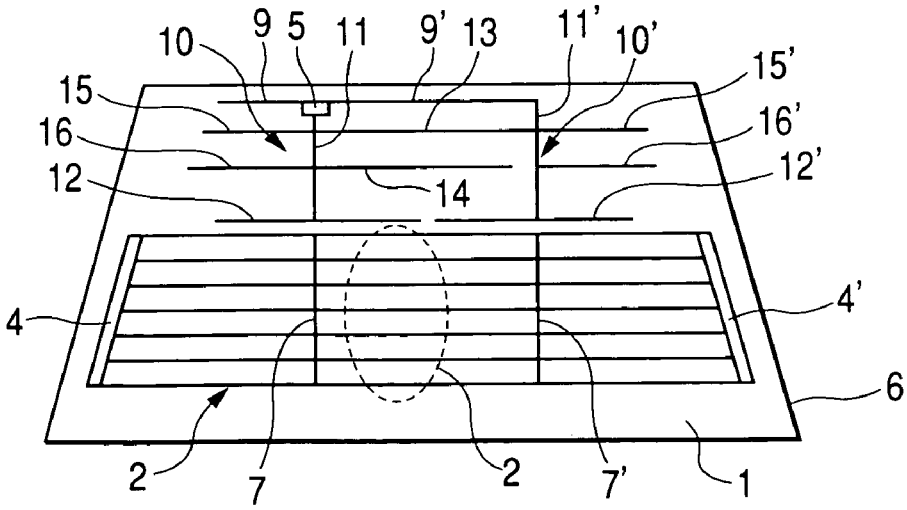
FIG. 2 is a front view illustrating embodiment 2 according to the invention in which a glass antenna is mounted on a rear window for automobiles.
Figure 3:
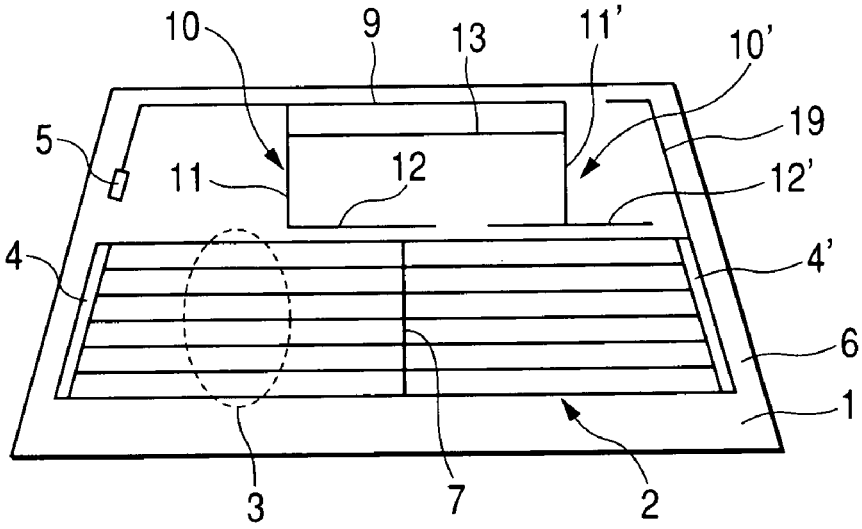
FIG. 3 is a front view illustrating embodiment 3 according to the invention in which a glass antenna is mounted on a rear window for automobiles.

Furthermore, as shown in FIGS. 1 to 3, a horizontal connecting wire 13 in parallel with the first horizontal wires 9, 9' is connected between the vertical wires 11, 11' of the two elements of the first element 10 and the second element 10' of the glass antenna, the vertical wires 11, 11' are branched and connected from the first horizontal wire 9 or 9', and a closed loop is formed in a nearly rectangular shape. Thus, the receiving property and the directional patterns can be expected to be further improved.

In this manner, the wire part enclosed by the wires, the horizontal wires 9, 9', the horizontal connecting wire 13, and the vertical wires 11, 11' of the two elements of the first element 10 and the second element 10', is formed into a closed loop, and thus the receive gain can be expected to be increased. This is because a wide element can be considered to be formed from the horizontal wires 9, 9' to the horizontal connecting wire 13 and the radio waves received by the elements 10, 10' can be transmitted efficiently as well as the effective capacity necessary for improving the AM band gain is increased.

Moreover, as shown in FIG. 2, it is acceptable that horizontal auxiliary wires 15, 15' are horizontally extended from the both ends of the horizontal connecting wire 13 toward the outer vertical sides.

In addition, the following length is acceptable. The total length of the first horizontal wires 9, 9' that is capacitive-coupled to the inner opening part of the upper side of the window frame 6 is set from 400 to 1,000 mm. The length of each of the second horizontal wires 12, 12' of the two elements of the first element 10 and the second element 10' is within the range of 200 to 500 mm. The distance between the vertical wires 11, 11' of the two elements of the first element 10 and the second element 10', which are branched from the horizontal wires 9, 9', is set from 100 to 800 mm.

The reason why the total length of the first horizontal wires 9, 9' is set from 400 to 1,000 mm and the length of each of the second horizontal wires 12, 12' is set within the range of 200 to 500 mm is that the length of the horizontal wire 9 is formed to be the length equivalent to one-fourth of the wavelength $\lambda$ to efficiently pick up the radio waves of vertical polarization mainly received by the body in order to increase the gain of a frequency band of 76 to 108 MHz to be received by the antenna according to the invention.

Furthermore, the reason why the length of each of the second horizontal wires 12, 12' is set within the range of 200 to 500 mm is that the radio waves of horizontal polarization and vertical polarization received by the hot wires are sufficiently picked up and are controlled so as to match the phase with the horizontal wire 9 and consequently it is found that the receive gain is most increased within that range.

Besides, the reason why the length of 100 to 800 mm is fine for the distance between the vertical wires 11, 11' of the two elements of the first element 10 and the second element 10' is as follows. The radio waves received by the two elements of the first element 10 and the second element 10' are controlled to obtain high gain with respect to a low frequency band and a high frequency band of the receiving frequency band. The two elements of the first element 10 and the second element 10' are combined, the distance between the vertical wires 11, 11' of the two elements of the first element 10 and the second element 10' is separated from 100 to 800 mm, and then a receiving band of 76 to 108 MHz is optimally separated in a low frequency band and a high frequency band to shift receiving frequencies. Therefore, a high-gain antenna can be formed throughout wide-band frequencies.

Furthermore, preferably, one or a plurality of vertical wires 7, 7', . . . disposed orthogonally to a plurality of the horizontal heating conductor wires 3, 3, . . . of the defogger . . . 2 is arranged in the horizontal heating conductor wires 2, 2, at the position where the vertical wires are arranged in bilateral symmetry with respect to the center line of the rear window 1. In addition, when there is a single vertical wire 7, it is also acceptable that it is arranged at the position near the center line of the rear window 1.

The extension lines of a plurality of the vertical wires 7, 7' arranged in the defogger 2 are not necessarily disposed so as to be matched with the vertical wires 11, 11' of the two elements of the first element 10 and the second element 10'.

Moreover, as shown in FIG. 1 to FIG. 4, it is acceptable that at least one or more of horizontal auxiliary wires 14 to 18 are horizontally disposed from the vertical wires 11, 11' of the two elements of the first element 10 and the second element 10'.

As for the position of the feeding point 5 of the antenna according to the invention, it is disposed at the position near the upper side of the opening part of the metal window frame 6 of the rear window 1 of the vehicle, or the position near the vertical side above the bus bar 4, and the first horizontal wire 9 from the feeding point 5 along the upper side of the window frame is disposed at the position within the range of 1 to 10 mm from the upper side of the window frame 6. Thus, the wire is capacitive-coupled to the metal body of the automobile, and the first horizontal wires 9, 9' receive the radio waves on the metal body of the automobile. Therefore, the performance of receiving the FM radio broadcast waves can be more enhanced than the case where the radio waves are received only by an antenna at the position not close to the metal body.

Furthermore, the reason why the second horizontal wires 12, 12' of the two elements of the first element 10 and the second element 10' are brought close to the uppermost wire of the heating conductor wires 3, 3, . . . and capacitive-coupled thereto within the range of 1 to 10 mm is that the performance of receiving the FM radio broadcast waves can be more enhanced than the case where the radio waves on the heating conductor wires 3, 3, . . . of the defogger 2 are received by the second horizontal wires 12, 12' capacitive-coupled and are received only by the antenna at the position not close to the heating conductor wires 3, 3, . . . of the defogger 2.

The distance between the first horizontal wires 9, 9' and the horizontal connecting wire 13 joining the two elements of the first element 10 and the second element 10' is set from 1 to 60 mm, preferably the distance of 5 to 30 mm, and these wires are formed into a closed loop in a nearly rectangular shape. Therefore, the Q-value, which is resonance sharpness, can be made small, and the wide-band frequency response can be obtained.

It is acceptable that the tip ends of the first horizontal wires 9, 9' are extended to near the corner parts and further extended to the position above the bus bar along one vertical side in an L-shape.

The auxiliary elements 14 to 18 extended so as to be horizontally branched from the vertical wires 11, 11' of two elements of the first element 10 and the second element 10' are effective not only for impedance matching with an amplifier or a radio connected to the antenna, which are not shown in the drawing, but also particularly in receiving the AM radio broadcast waves.

Although the antenna according to the invention can be used alone sufficiently, it is of course acceptable that the antenna according to the invention is combined with another antenna mounted on the rear window, an antenna mounted on the front window, an antenna mounted on the side window, and a pole antenna such as a whip antenna for diversity reception.

Embodiment 1

As shown in FIG. 1, a defogger 2 formed of a plurality of heating conductor wires 3, 3, . . . arranged nearly horizontally and bus bars 4, 4' connected to both ends thereof is disposed on the inner surface of a plate glass 1 mounted on a rear window for vehicles, and an antenna according to the invention is disposed on the upper remaining part above the defogger 2.

In the antenna according to the invention, a feeding point 5 is disposed at the position near the upper side of a window frame, and first horizontal wires 9, 9' are disposed along the opening side of the window frame so as to come closer to the opening side of the window frame than the feeding point 5.

The two elements of the first element 10 in an inverted L-shape and the second element 10' in an inverted T-shape are connected to the feeding point 5 and to the tip end of the first horizontal wire 9 in the right and left areas with respect to the center line of the rear window 1. More specifically, in the two elements of the first element 10 and the second element 10', the vertical wires 11, 11' are extended from the first horizontal wires 9, 9' to near the uppermost heating conductor wire 3 of the defogger 2, the second horizontal wires 12, 12' are horizontally disposed from the lower ends of the two vertical wires 11, 11',and the second horizontal wires 12, 12' are brought close to the heating conductor wire 3.

Furthermore, in the heating conductor wires 3, 3, . . . forming the defogger 2, the vertical wires 7, 7' are disposed in bilateral symmetry, and the vertical wire 11' of the antenna element 10' is arranged so as to be on the same line as the vertical wire 7'.

Moreover, the horizontal connecting wire 13 in parallel with the first horizontal wires 9, 9' is disposed between the vertical wires 11, 11' branched and connected from the first horizontal wires 9, 9' of the two elements of the first element 10 and the second element 10', and a closed loop is formed.

Besides, the horizontal auxiliary wire 14 extended horizontally from the vertical wire 11 toward the vertical wire 11' is disposed in the midway parts of the vertical wires 11, 11' branched and connected from the first horizontal wires 9, 9' of the two elements of the first element 10 and the second element 10'.

The rear window 1 is in a nearly trapezoid, and the dimensions are upper-side length A=1,260 mm, lower-side length B=1,330 mm, and vertical-side length C=520 mm.

The length of each of the wires is as follows.

The length of the first horizontal wire 9=150 mm

The length of the first horizontal wire 9'=400 mm

The distance between the vertical wires 11, 11' of the first and second elements 10, 10'=480 mm The length of the vertical wire 11 of the first element 10=85 mm The length of the second horizontal wire 12=345 mm The length of the vertical wire 11' of the second element 10'=85 mm The length of the second horizontal wire 12'=345 mm The distance between the first horizontal wire 9 and the upper side of the window frame 6=5 mm The distance between the second horizontal wires 12, 12' and the uppermost heating conductor wire 3=5 mm The length of the horizontal connecting wire 13=480 mm The length of the horizontal auxiliary wire 14=460 mm The distance from the center of the vertical wires 7, 7'=200 mm The glass antenna of the dimensions was printed with a conductive paste, fired and then formed.

The rear window thus obtained was mounted on the rear window of an automobile, and a direct-current power supply circuit is connected to the bus bars 4, 4' on both sides.

In the state of connecting the direct-current power supply circuit, the horizontal polarization of an FM radio broadcast wave band of 76 to 90 MHz and the horizontal polarization of an FM radio broadcast wave band of 88 to 1.08 MHz were received by the antenna according to the invention, and the receive gain of a whip antenna was 0 dB. Then, the gain differences are expressed. The average is +4.9 dB and +4.4 dB, respectively, and the gain exceeds the receive gain of the whip antenna in a tuned band of 76 to 108 MHz, revealing that the antenna is a highly excellent antenna.

Figure 5:
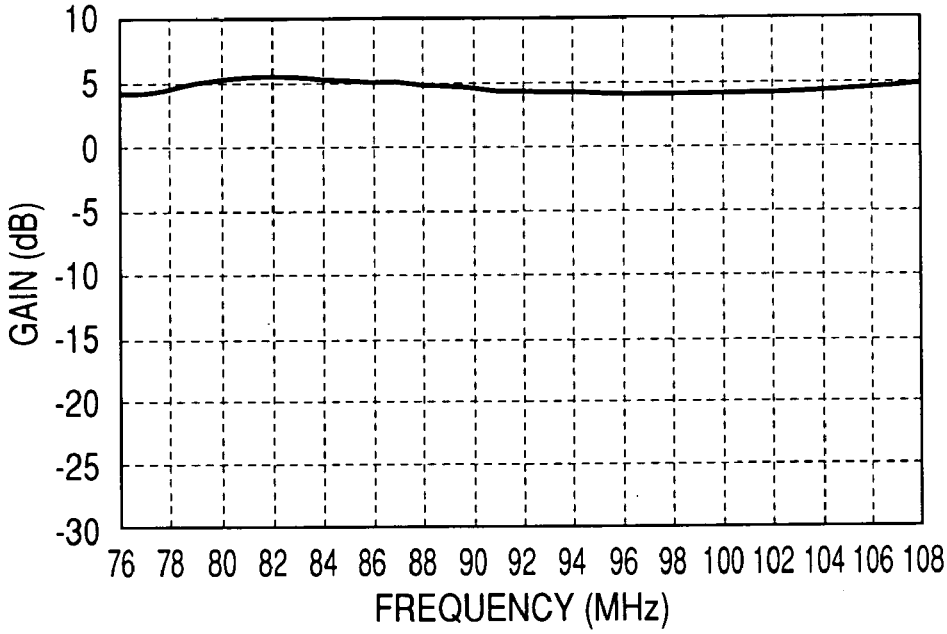
FIG. 5 is a diagram of the frequency response of 76 to 108 MHz in embodiment 1 according to the invention.

Moreover, the frequency response showing the receive gain at each frequency at that time is as shown in FIG. 5 in this embodiment. It is revealed that a high receive gain can be obtained in a wide band of 76 to 108 MHz.

Besides, the radio waves of an AM radio band of 500 to 1800 KHz were received to measure the receiving performance. It exceeds the receiving performance of the whip antenna by about 3 dB in the entire bands, and it is revealed that the antenna is a highly excellent antenna for the AM radio broadcast wave band.

Embodiment 2

An example shown in FIG. 2 is a modified example of embodiment 1 shown in FIG. 1. An element 10 is formed in an inverted T-shape and directly connected to a feeding point 5, an element 10' is extended from the tip end of a first horizontal wire downward, and they are connected in bilateral symmetry with respect to the center line of a rear window 1.

More specifically, in the two elements of the first element 10 and the second element 10', vertical wires 11, 11' are extended from the first horizontal wires 9, 9' to near an uppermost heating conductor wire 3 of a defogger 2, second horizontal wires 12, 12' are horizontally disposed from the lower ends of the two vertical wires 11, 11', and the second horizontal wires 12, 12' are brought close to the heating conductor wire 3.

Furthermore, in heating conductor wires 3, 3, . . . forming the defogger 2, vertical wires 7, 7' are arranged in bilateral symmetry, the vertical wires 11, 11' of the antenna elements 10, 10' are disposed so as to be on the same line as the vertical wires 7, 7', and a plurality of horizontal auxiliary wires 14, 15, 16, 15', 16' is disposed from the midway parts of the vertical wires 11, 11' in the lateral direction. The others are the same as embodiment 1.

The dimensions of a plate glass 1 and the length of each of the wires are almost the same as those of embodiment 1, but the different parts will be described below.

The distance between the vertical wires 11, 11' of the first and second elements 10, 10'=400 mm The length of the second horizontal wire 12=275 mm The length of a horizontal connecting wire 13=400 mm The length of the horizontal auxiliary wire 14=380 mm The length of the horizontal auxiliary wires 15, 15'=180 mm The length of the horizontal auxiliary wire 16, 16'=200 mm The plate glass thus obtained is mounted on the rear window of an automobile, and a direct-current power supply is connected to bus bars 4, 4' on both sides.

In a state of connecting the direct-current power supply, the vertical polarization of the FM radio broadcast wave band of 88 to 108 MHz was received by the antenna according to the invention, and the receive gain of the whip antenna was 0 dB. Then, the gain difference is expressed. The average is +3.0 dB, and the gain exceeds the receive gain of the whip antenna in a tuned band of 88 to 108 MHz, revealing that the antenna is a highly excellent antenna.

Figure 6:
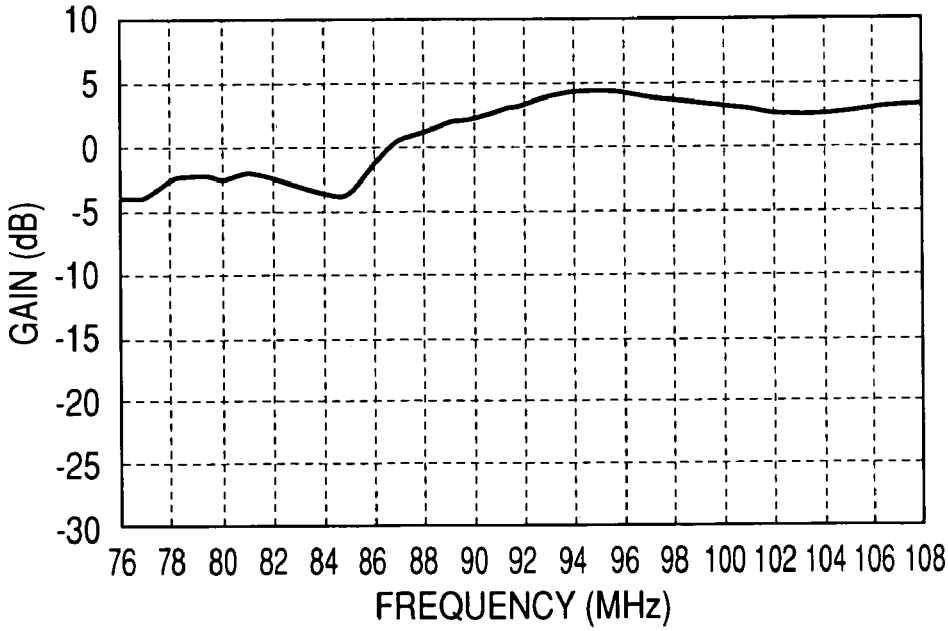
FIG. 6 is a diagram of the frequency response of 88 to 108 MHz in embodiment 2 according to the invention.

Moreover, the frequency response showing the receive gain at each frequency at that time is as shown in FIG. 6 in this embodiment. It is revealed that a high receive gain can be obtained in a wide band of 88 to 108 MHz.

Besides, the radio waves of the AM radio band of 500 to 1800 KHz were received to measure the receiving performance. The receive gain as similar to that of embodiment 1 was obtained. The antenna was a highly excellent antenna for the AM radio broadcast wave band.

Embodiment 3

In an example shown in FIG. 3, a feeding point 5 is disposed at the position near the vertical side of a window frame, a conductor wire is extended from the feeding point 5 along the vertical side and the upper side of the window frame, a first horizontal wire 9 is disposed along the opening side of the upper side of the window frame, and a single vertical wire 7 is disposed in the center part of heating conductor wires 3, 3, forming a defogger 2.

Furthermore, an auxiliary element 19 is disposed from a bus bar 4' on the right side to near the upper right corner of the window frame so as to come close to the opening side of the vertical side of the window frame.

Moreover, the horizontal auxiliary wire 14 (see, FIG. 1) described in embodiment 1 is not disposed for two vertical wires 11, 11' of two elements of the first element 10 and the second element 10' connected to the first horizontal wire.

The others are the same as embodiment 1.

A plate glass thus obtained is mounted on the rear window of an automobile, and a direct-current power supply circuit is connected to bus bars 4, 4' on both sides. In this state, the horizontal polarization of FM radio broadcast waves of 76 to 90 MHz and the horizontal polarization of TV broadcast waves of 90 to 108 MHz were received by the antenna according to the invention, and the receive gain of the whip antenna was 0 dB. Then, the gain differences are expressed. The average is +3.7 dB, and +5.1 dB, respectively, in the glass antenna, and the gain exceeds the receive gain of the whip antenna in a tuned band of 76 to 108 MHz, revealing that the antenna is a highly excellent antenna.

Besides, the radio waves of the AM radio band of 500 KHz to 1800 KHz were received to measure receiving performance. The same receive gain as that of embodiments 1 and 2 was obtained, showing that the antenna was also a highly excellent antenna for the AM radio broadcast wave band.

Embodiment 4

In an example shown in FIG. 4, a feeding point 5 is disposed at the position near the center of the upper side of a window frame, and first horizontal wires 9, 9' are disposed from the feeding point 5 along the opening side of the upper side of the window frame in the lateral direction. Two elements of a first element 10 and a second element 10' having the base component in an inverted T-shape are arranged in the midway parts of the first horizontal wires 9, 9' in bilateral symmetry with respect to the center line of a rear window 1.

Furthermore, a plurality of horizontal auxiliary wires 14, 15, 15', 17, 18, 18' is horizontally arranged from vertical wires 11, 11' of the two elements of the first element 10 and the second element 10'. The configuration does not have the closed loop structure with the horizontal connecting wire 13 (see, FIG. 1) as shown in embodiment 1.

Moreover, this embodiment has the same configuration as that of embodiment 1, except that four vertical wires 7, 7', 7', 7' are arranged in bilateral symmetry in heating conductor wires 3, 3 . . . forming a defogger 2.

Besides, TV antennas 23, 24, different from the antenna according to the invention, are disposed in the right and left remaining parts of the antenna according to the invention, and connected to feeding points 21, 22 one each for diversity reception with the antenna according to the invention. Although a single use of the antenna according to the invention can show an excellent receiving performance as well, it performs diversity reception with the antennas 23, 24 to further enhance the directional patterns.

A plate glass 1 thus obtained is mounted on the rear window of an automobile, and a direct-current power supply circuit is b connected to us bars 4, 4' on both sides. In this state, the horizontal polarization of TV broadcast waves of 90 to 108 MHz, the horizontal polarization of TV broadcast waves of 170 to 222 MHz, and the horizontal polarization of TV broadcast waves of 470 to 770 MHz were received by the antenna according to the invention, and the receive gain of the whip antenna was 0 dB. Then, the gain differences are expressed. The average is +4.5 dB, +1.6 dB, and +1.3 dB, respectively, in glass antenna, and the gain exceeds the receive gain of the whip antenna in tuned bands of 76 to 108 MHz, 170 to 222 MHz, and 470 to 770 MHz, revealing that the antenna is a highly excellent antenna.

Incidentally, in the above embodiments, the heating conductor wires 3 and the antenna 8 may be provided on the plate glass 1 by printing. Apart from this, the plate glass 1 may be formed by a plurality of glass plates that are laminated by using a resin such as PVB (polyvinyl butyral). In this case, the conductor wires 3 and the antenna 8 may be attached to the resin to be sandwiched by the glass plates.

According to the invention, the first horizontal wires of the antenna mounted on the upper remaining part above the heating conductor wires of the defogger are disposed so as to be brought close to the upper side of the window frame and capacitive-coupled thereto, and each of the horizontal wires of the two elements branched from the first horizontal wires is disposed so as to be brought close to the uppermost heating conductor wire and capacitive-coupled thereto. Therefore, the radio waves received by the metal body of the automobile are picked up by the antenna as well as the radio waves received by the heating conductor wires of the defogger can be picked up. The elements 10, 10' receive and combine different frequencies to allow the receive gain to be enhanced throughout a wide band.

Furthermore, a plurality of the vertical wires arranged so as to be intersected and connected to a plurality of the heating conductor wires of the defogger allows the defogger to receive the same radio waves as the radio waves received by the antenna and to transmit them to the antenna. Particularly, the receive gain of the FM radio broadcast waves is increased to the extent of exceeding the reception level of the whip antenna throughout a wide band not only in the FM band of 76 to 90 MHz but also in the FM broadcast wave band of 88 to 108 MHz and the TV broadcast wave band. In addition to this, the antenna can increase the receive gain to the extent of exceeding the reception level of the whip antenna for the AM radio broadcast waves depending on vehicle types.

What is claimed is:

1. A glass antenna for a vehicle, comprising:

a rear window surrounded by a metal window frame, the rear window including a defogger and antenna wires disposed on an upper remaining part of the rear window above the defogger, the defogger having a plurality of horizontal heating conductor wires extending almost horizontally and bus bars connected to both ends of the plurality of horizontal heating conductor wires;

wherein the antenna wires include:

a feeding point disposed at a position near an inner-upper side or vertical side of the metal window frame;

a first horizontal wire extending from the feeding point and being disposed along the inner-upper side of the metal window frame at an interval within a range of 1 to 10 mm to be capacitive-coupled thereto; and two elements each branched from and connected to the first horizontal wire;

the two elements are disposed in respective areas that constitute a right half part and a left half part of the upper remaining part; and each of the two elements has a second horizontal wire disposed along one of the horizontal heating conductor wires at an interval within a range of 1 to 10 mm to be capacitive-coupled thereto.

2. The glass antenna for a vehicle according to claim 1, further comprising a third horizontal wire;

wherein each of the two elements has a vertical wire that is branched from and connected to the first horizontal wire; and the third horizontal wire is disposed between the vertical wires and in parallel with the first horizontal wire, forming a closed loop with the vertical wires and the first horizontal wire.

3. The glass antenna for a vehicle according to claim 1, wherein the first horizontal wire is set from 400 to 1,000 mm in length.

4. The glass antenna for a vehicle according to claim 1, wherein the second horizontal wires are set within a range of 200 to 500 mm in length.

5. The glass antenna for a vehicle according to claim 1, wherein each of the two elements has a vertical wire that is branched from and connected to the first horizontal wire; and the vertical wires of the two elements are separated at an interval from 100 to 800 mm.

6. The glass antenna for a vehicle according to claim 1, wherein at least one of the two elements has an inverted T-shape.

7. The glass antenna for a vehicle according to claim 1, wherein at least one of the two elements has an L-shape.

8. The glass antenna for a vehicle according to claim 1, wherein the defogger has at least one vertical wire disposed orthogonal to the plurality of the horizontal heating conductor wires and laterally symmetrical with respect to a center line of the rear window.

9. The glass antenna for a vehicle according to claim 1, wherein each of the two elements includes:

a vertical wire that is branched from and connected to the first horizontal wire; and at least one horizontal auxiliary wire extends horizontally from the vertical wire.

* * * * *